US007163434B2

(12) United States Patent
James

(10) Patent No.: US 7,163,434 B2
(45) Date of Patent: Jan. 16, 2007

(54) METHOD AND APPARATUS FOR GENERATING COMPLEX SHAPES ON CYLINDRICAL SURFACES

(75) Inventor: John James, Anaheim, CA (US)

(73) Assignee: Ceradyne, Inc., Costa Mesa, CA (US)

( * ) Notice: Subject to any disclaimer, the term of this patent is extended or adjusted under 35 U.S.C. 154(b) by 0 days.

(21) Appl. No.: 10/951,298

(22) Filed: Sep. 27, 2004

(65) Prior Publication Data

US 2006/0228990 A1 Oct. 12, 2006

(51) Int. Cl.
*B24B 49/00* (2006.01)

(52) U.S. Cl. ..... 451/5; 451/49

(58) Field of Classification Search ..... 451/49, 451/142, 163, 173, 5, 24
See application file for complete search history.

(56) References Cited

U.S. PATENT DOCUMENTS 2,025,010 A * 12/1935 Balsiger ..... 451/142
3,469,353 A * 9/1969 Klein ..... 451/149
4,218,850 A * 8/1980 Sakai et al. ..... 451/142
5,447,463 A * 9/1995 Schmitz ..... 451/14
6,234,885 B1 * 5/2001 Haferkorn ..... 451/290
6,257,964 B1 * 7/2001 Helgren ..... 451/49
6,379,227 B1 * 4/2002 Hellman et al. ..... 451/49

* cited by examiner

*Primary Examiner*—Robert A. Rose
(74) *Attorney, Agent, or Firm*—Leonard Tachner

(57) ABSTRACT

A method and apparatus for shaping the radial surface of a roller or other cylindrically shaped part in a single cycle. The preferred embodiment forms a crown geometry on one roller at a time using a CNC system to control a grinding surface in three axes. The grinding surface is controlled in two linear orthogonal directions (x and y) and around a circular axis (c) through corresponding stepper motors. In addition, the axial pressure applied by the grinding surface of the radial surface of the roller is controlled by an air pressure programmable regulator acting through a pneumatic cylinder. These four individually controlled, precise degrees of motion of the grinding surface, operating with a single rotating roller, permits extremely accurate crown shaping. The shaping is, in fact, so precisely controlled and so accurate that only one "cycle" of the grinding surface against the roller is required to achieve the desired crown profile.

8 Claims, 10 Drawing Sheets

METHOD AND APPARATUS FOR GENERATING COMPLEX SHAPES ON CYLINDRICAL SURFACES

BACKGROUND OF THE INVENTION

1. Field of the Invention

The present invention relates generally to a manufacturing method and apparatus therefor to generate complex shapes on cylindrical surfaces. The invention relates more specifically to a method and apparatus for altering the geometry of the radial surface of cylindrical rollers to extremely precise specifications in a reliable and repeatable manner and in a minimum amount of time.

2. Background Art

Ceramic materials are being used to a greater degree in vehicle engines. Ceramics such as silicon nitride, exhibit physical characteristics which are extremely beneficial in the harsh environment of diesel and internal combustion engines. Engine parts made from silicon nitride are more resistant to high temperature effects because they have a lower coefficient of thermal expansion than conventional metal parts. They are also more resistant to friction and wear, have high strength and resist oxidation. Their low mass compared to parts made of ferrous metals makes them attractive in weight sensitive applications and in high speed applications. One application where silicon nitride has especially proved its advantages is in the form of rollers such as cam rollers in diesel and spark ignited engines.

To understand the benefits of silicon nitride cam rollers, one must first understand the failure mode of metal cam rollers. A metal cam roller system for heavy-duty diesel engines consists of a steel roller with a bronze pin. The metal roller runs against a steel cam. The failure begins as the bronze pin wears. The wear is accelerated because bronze is a relatively soft metal. The wear of the pin makes it more difficult for the metal roller to rotate. This then results in skidding against the cam lobe and ultimately scuffing, micro welding and galling of both the cam roller and the cam lobe. Fatigue failure will follow. Higher contact stresses of new diesel engines accelerate the above process.

A silicon nitride based system consists of a silicon nitride cam roller and a hardened steel pin. The use of a harder pin material eliminates the root cause of failure in the metal cam roller system, the bronze pin. The use of a silicon nitride cam roller eliminates the problem of wear and galling of the metal roller. Silicon nitride has a very low coefficient of friction versus steel (approximately 0.05 lubricated) and a very low mass (3.2 grams per cubic centimeter, 60% lighter than steel) which gives the silicon nitride cam roller a lower moment of inertia, making it easier to rotate against the cam and reducing the chance of skidding against the cam lobe.

Silicon nitride is very compatible with steel from a wear standpoint. The measured wear of a steel pin in a silicon nitride cam roller system is over 95 percent lower than the corresponding wear with a steel roller and bronze pin. No micro welding will occur with the silicon nitride cam roller system because of the dissimilarity of materials. Silicon nitride cam roller systems eliminate the major failure modes of metal cam rollers, and are proven to reduce cam lobe wear and increase cam lobe life, even at higher contact stresses. Additionally, silicon nitride has a better rolling contact fatigue life than bearing steels, resulting in a system with improved reliability The reliability of silicon nitride has been demonstrated by the fact that millions of rollers are currently in engines with no reported field failures by material related problems. This excellent mechanical reliability is due to processing techniques that result in no porosity on wear surfaces. The absence of porosity eliminates the major cause of contact fatigue failure.

The cost of silicon nitride components is significantly higher than steel components. This can be addressed by minimizing the cost of raw materials through the use of sintered reaction bonded silicon nitride processing. Improvements in continuous and semi-continuous ceramic process and grinding procedures can further reduce the cost difference between silicon nitride and metal. With sufficient reduction in cost difference, silicon nitride components can be justified on the basis of the life cycle and performance improvements compared to metal components. For example, engine life costs can be reduced because problems related to fatigue in metal rollers or cam lobes during the warranty life of an engine do not arise when the ceramic alternative is used.

Silicon nitride can be a cost effective material solution that eliminates wear and galling of the cam rollers and the adjoining cam lobe, or pump rollers and the adjoining metal components. The use of silicon nitride components has eliminated warranty problems in these applications and has resulted in increased engine reliability.

Cylindrical rollers employed in engines require precise grinding to generate a crown shape on the radial surface. Otherwise, a perfectly straight radial surface, when under radial load, can result in damage from the interaction of the axial edges with the cam or other interface. Typically, a crown shape consists of a slight reduction in outer diameter with the maximum reduction at the axial edges and little or no reduction at the center of the axial length of the radial surface. The amount of diameter reduction is measured in ten-thousandths of an inch. The currently known method for grinding a precise crown shape onto a silicon nitride roller is carried out on a machine receiving a large number of ceramic rollers. The rollers are placed in contiguous relation to two almost parallel large spinning rollers having undulating surfaces and which impart a rotational force onto each of the individual rollers on the spindle. A contoured grinding surface containing diamond powder is lowered into contact with the rollers to form the crown shape on the respective radial surfaces of the rotating rollers. The undulating surfaces of the large rollers cause the workpiece rollers to tilt slightly to allow the grinding surface to create the crown shape.

This conventional process would appear to provide an efficient way of shaping multiple rollers simultaneously, but there are multiple problems as well. There are only two available directions of movement. The grinding surfaces can be moved up and down and the rollers on their mandrel can be translated along their common axis. The tilting of the rollers is relatively imprecise and also creates instability during grinding. Because of the limited freedom of movement, it is difficult to generate the desired shape on one cycle. In fact, it usually takes six or seven cycles before each roller is properly shaped. Assessment of the rollers after each cycle is required before carrying out the next cycle. Each assessment requires examination under a profiling instrument which means removing each roller from its spindle before assessing it and placing it back on a spindle before the next cycle. The cumulative effect of multiple cycles and multiple assessments causes the average grinding time per roller to be longer than desirable and to add substantially to the labor costs per roller. Moreover, the prior art crowning process is relatively imprecise thereby often resulting in roundness degradation and oversized crowns which do not meet geometric requirements. It would therefore be highly advantageous if it were possible to provide a reliable single cycle crown shaping method and apparatus with more dependable yield.

SUMMARY OF THE INVENTION

The present invention is a method and apparatus for shaping the radial surface of a roller or other cylindrically shaped part in a single cycle. The preferred embodiment shapes one roller at a time using a CNC system to control a grinding surface in three axes. The grinding surface is controlled in two linear orthogonal directions (x and y) and around a circular axis (c) through corresponding stepper motors. In addition, the axial pressure applied by the grinding surface of the radial surface of the roller is controlled by a programmable air pressure regulator acting through a pneumatic cylinder. These four individually controlled, precise degrees of motion of the grinding surface, operating with a single rotating roller, permits extremely accurate crown shaping. The shaping is, in fact, so precisely controlled and so accurate that only one "cycle" of the grinding surface against the roller is required to achieve the desired crown profile. In a preferred embodiment, a second, finer grinding surface is provided to achieve fine control of crown shape. However, this second grinding surface is automatically positioned into engagement with the roller by the CNC system without human intervention and without removing the roller from its spindle. It is, in effect, a single "cycle" with two stages of grinding, i.e., course and fine.

Another time saving attribute of the present invention results from the "one roller at a time" method thereof. More specifically, because the present invention is carried out on one roller at a time, the crown shaping process hereof can be conducted concurrently with other roller fabrication processes. By way of example, the crown shaping can be carried out on the outer radial surface in a robotic apparatus in which the roller's inner diameter is generated. This unique capability for essentially concurrent processes, effectively reduces the extra time needed for crowning a roller to zero.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
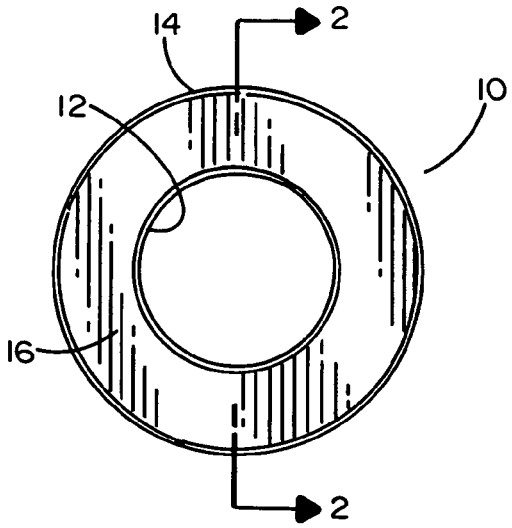
FIG. 1 is an axial end view of a typical roller with which the present invention is used.
Figure 2:
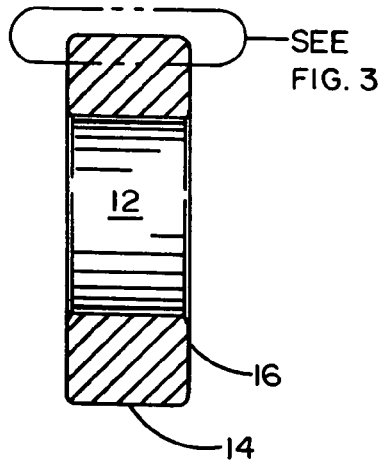
FIG. 2 is a cross-sectional radial view of the roller of FIG. 1.
Figure 3:
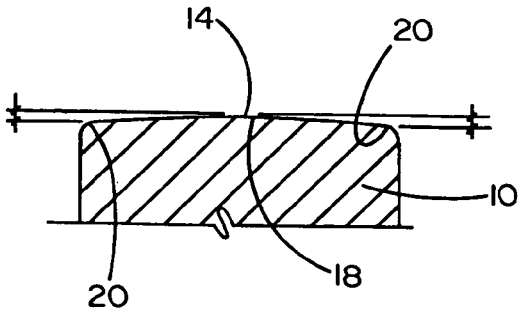
FIG. 3 is an enlarge view of a radial surface taken within the oval of FIG. 2.
Figure 4:
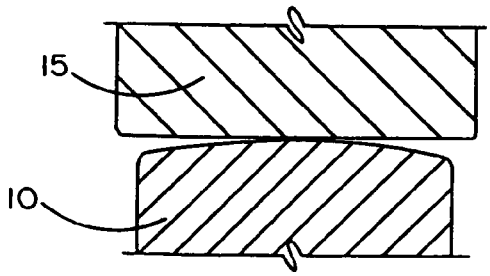
FIG. 4 is a view similar to that of FIG. 3, but showing the radial surface in contact with a bearing surface.

Referring to the accompanying drawings and initially to FIGS. 1–4, it will be seen that a typical ceramic roller 10 comprises an inner radial surface 12, an outer radial surface 14 and an axial surface 16. The outer radial surface 14 will have a preferred crown shape shown in FIGS. 3 and 4 wherein the crown center 18 has little or no reduction and the crown edges 20 have the largest extent of reduction. In this manner, when the roller 10 bears against a bearing surface 15, there is less likelihood of damage to that surface from the edges 20.

Figure 5:
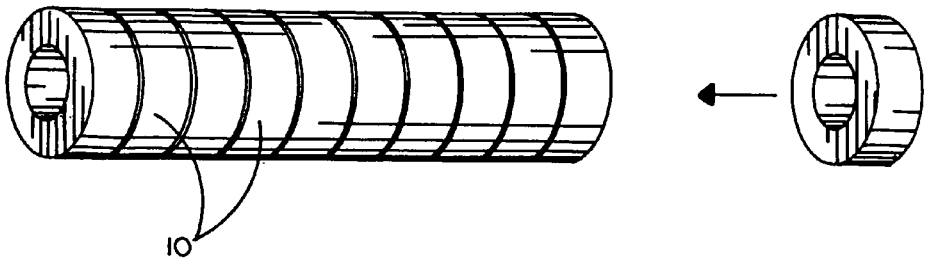
FIG. 5 (PRIOR ART)
FIG. 5 is a three-dimensional view of a prior art spindle and plurality of rollers ready for grinding in a conventional crowning apparatus.
Figure 6:
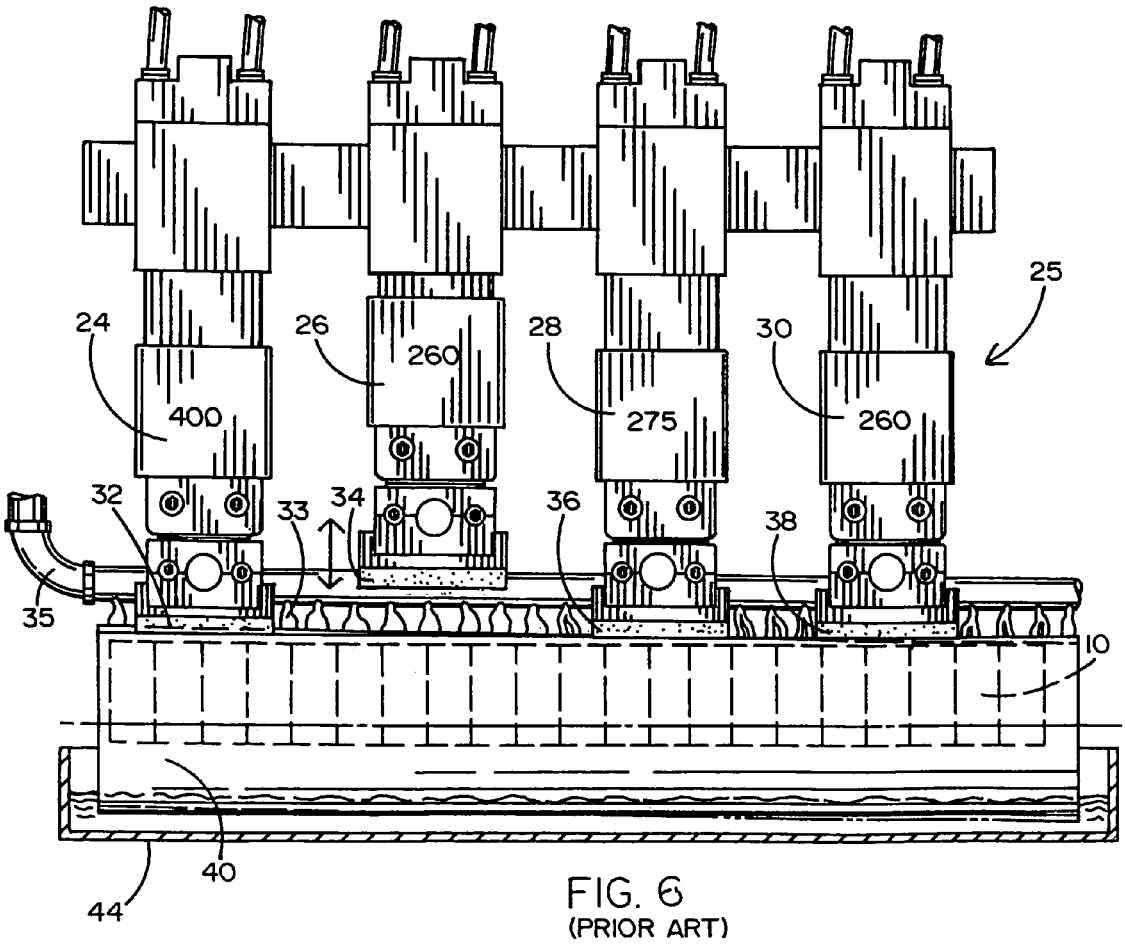
FIG. 6 (PRIOR ART)
FIG. 6 is a plan view of a conventional roller crowning apparatus.
Figure 7:
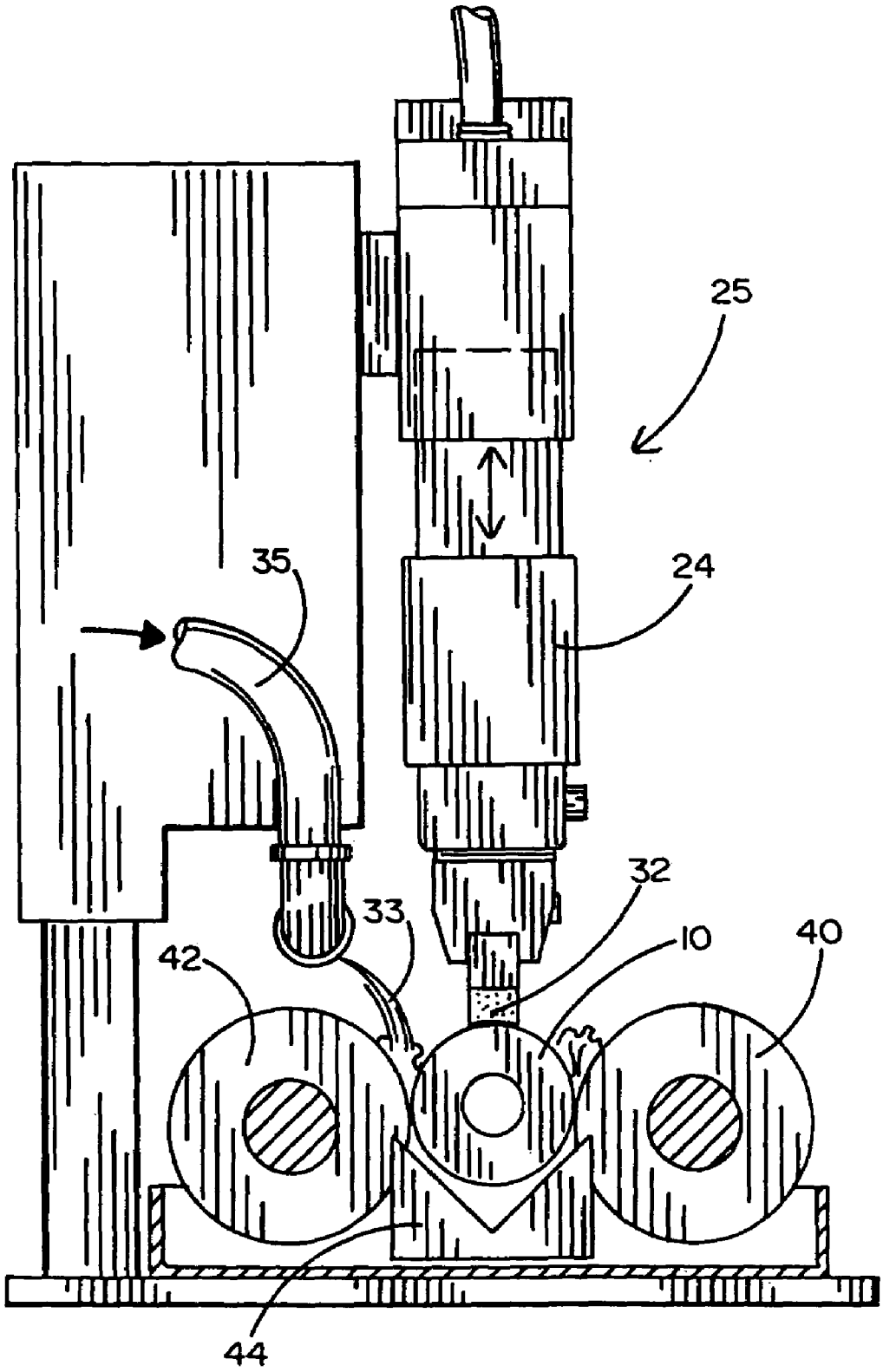
FIG. 7 (PRIOR ART)
FIG. 7 is an end view of the apparatus of FIG. 6.
Figure 7A:
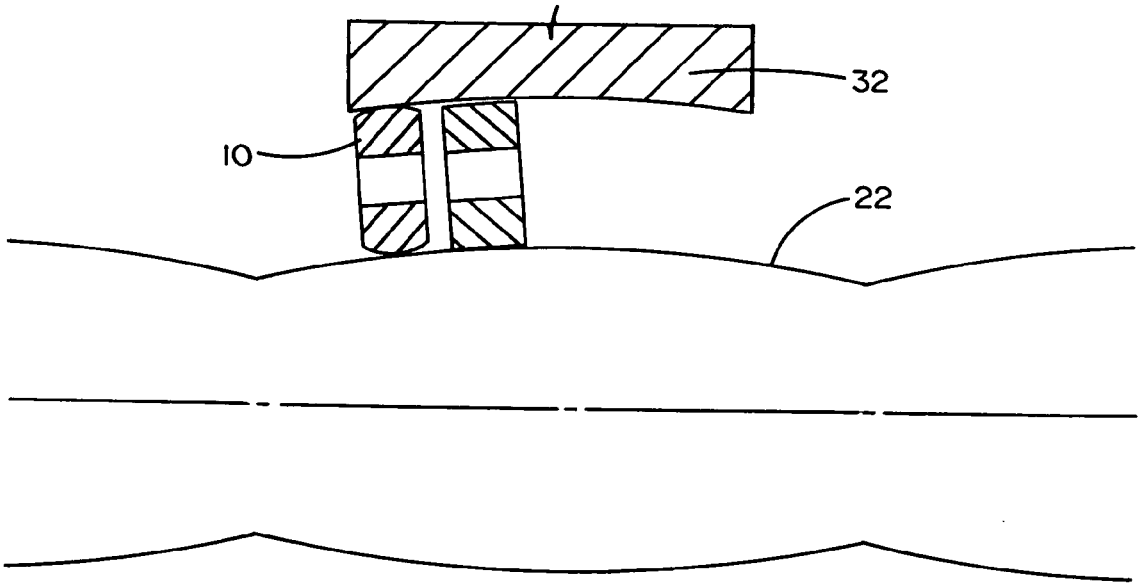
FIG. 7A (PRIOR ART)
FIG. 7A is a sectional view taken along lines A—A of FIG. 7.
Figure 7B:
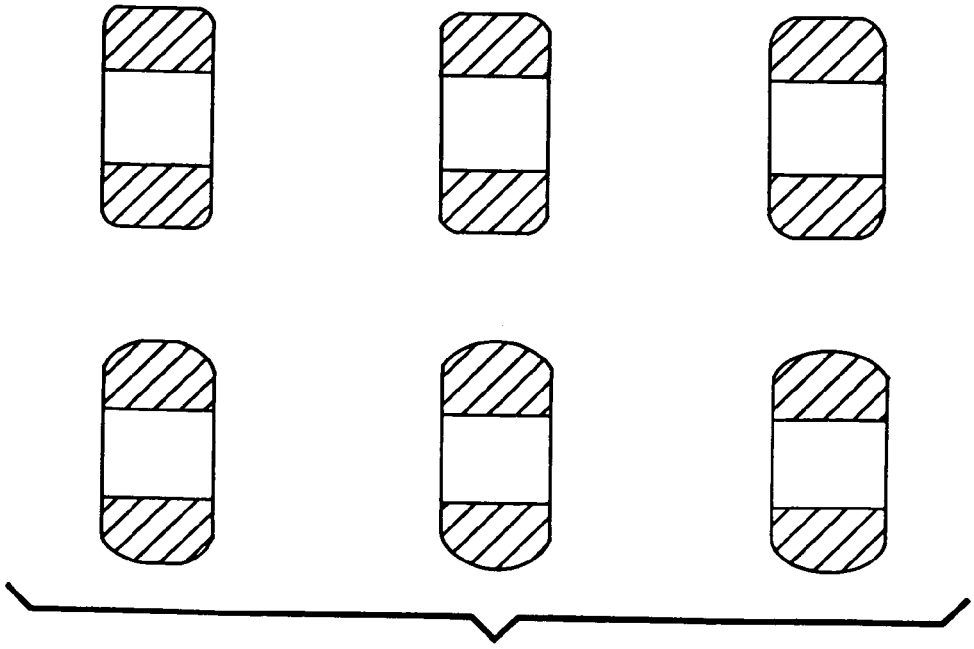
FIG. 7B is a sequential diagram of the prior art crowning effect on a typical roller.

The conventional or prior art method and apparatus for applying the crown shape to the roller 10 are shown in FIGS. 5–7B. Conventional roller crowning is accomplished in a batch process wherein a plurality of rollers 10 arranged contiguously as shown in FIG. 5 are placed in a crowning apparatus 25 shown in FIGS. 6 and 7. Apparatus 25 has a plurality of grinding actuators 24, 26, 28 and 30 mounted for vertical extension above a pair of parallel, spaced apart spinning metallic rollers 40 and 42. Each actuator terminates in a respective diamond matrix grinding surface 32, 34, 36 and 38. Respective grinding surfaces may have different degrees of grinding coarseness represented by the three-digit numerals shown on respective actuators in FIG. 6. Each such large metallic roller 40 and 42 has an undulating surface with an undulation length comparable to the width of about ten ceramic rollers 10. The ceramic rollers 10 are positioned between large rollers 40 and 42 above a lubricant receiving tray 44. A constant flow of lubricant 33 is delivered by a supply hose 35. The ceramic rollers 10 are spun by the large rollers 40 and 42 as respective grinding surfaces are applied to the outer radial surfaces of the ceramic rollers. The rollers 10 are made to tilt slightly on respective undulations 22 of the large rollers 40 and 42 so that their radial surfaces may be reduced as shown in FIGS. 3, 4, 7A and 7B. Those having skill in the relevant art will recognize the inherent difficulties in using such a batch process to achieve precise radial surface crowning profiles on ceramic rollers. In fact, an oversized crown and roller roundness degradation are just two common problems.

Referring now to FIGS. 8–13, it will be seen that a preferred embodiment of a high precision crowning apparatus 50 is shown therein. A unitary ceramic roller 10 is placed on the mount 53 of a spindle 52 for rotation by means of a motor 56 and gear box 54. The latter is preferably located on a positioning member 58 which, in turn, is mounted on a base 60. Member 58 provides linear and circular adjustability for locating the rotating roller 10 as desired relative to the grinding devices. A nut 55 may be used to secure the rollers 10 on the spindle 52 (see FIG. 12).

Figure 8:
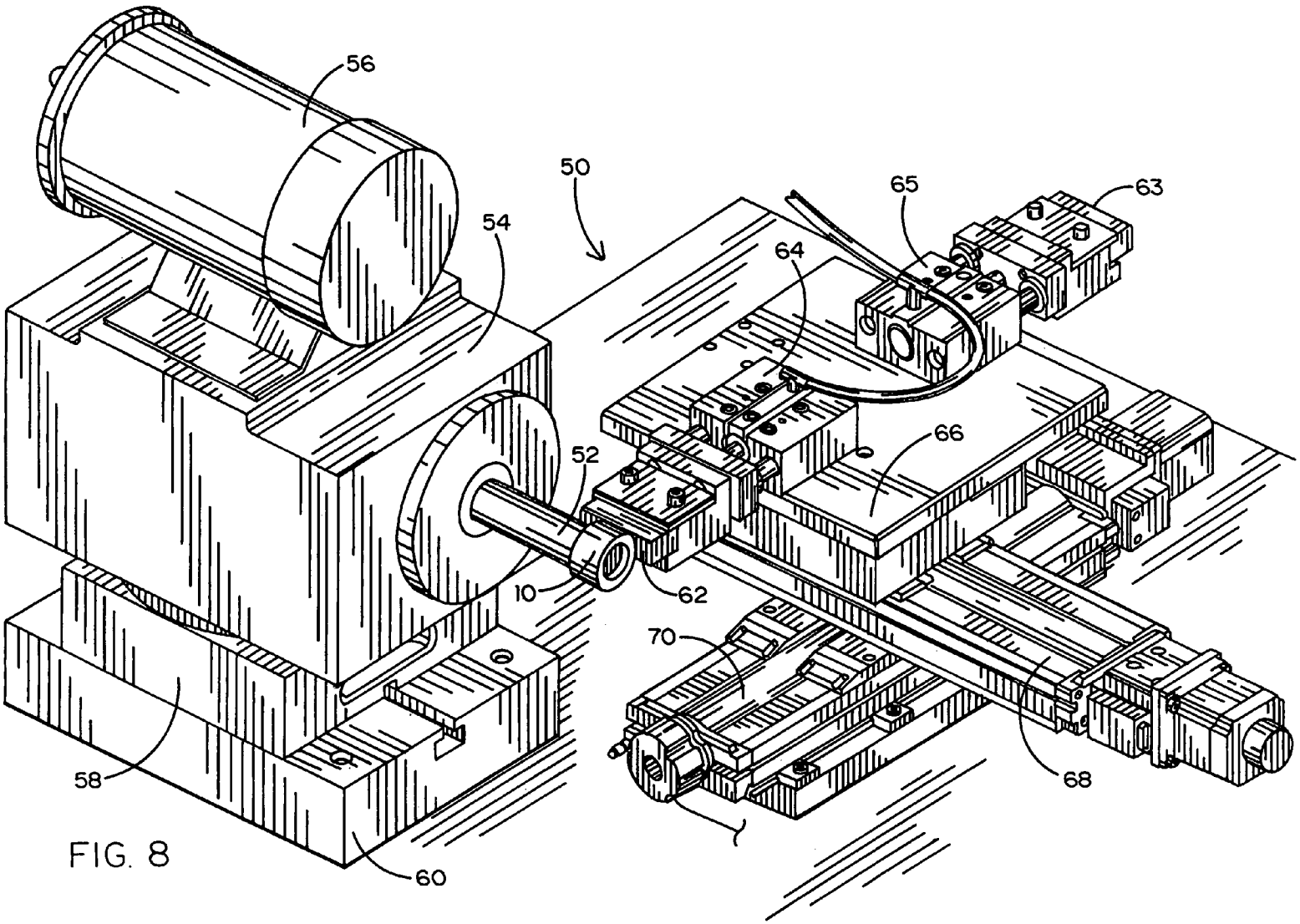
FIG. 8 is a three-dimensional view of a preferred embodiment of the present invention.
Figure 8A:
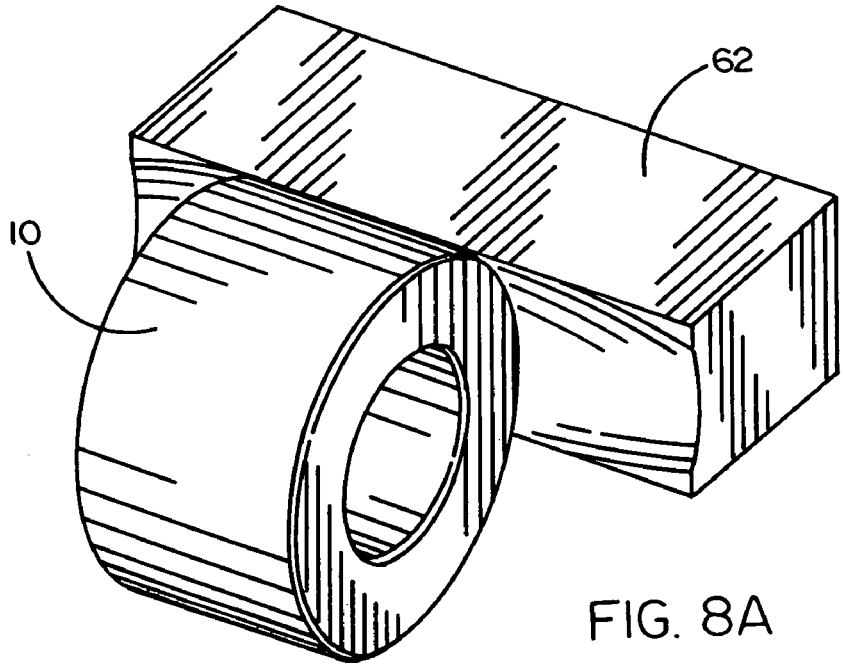
FIG. 8A is an enlarged view of the roller and grinding device of FIG. 8.

Grinding devices 62 (coarse) and 63 (fine) connected to respective pneumatic controls 64 and 65, are mounted on opposed edges of a support platform 66. Platform 66 is mounted on a stepper-motor-controlled turntable 67 (see FIG. 9) which, in turn, is mounted on a Y-axis stepper-motor-controlled actuator 68. The latter is mounted on an X-axis stepper-motor-controlled actuator 70. Thus, unlike the prior art crowning apparatus of FIGS. 5–7, the apparatus of the present invention maintains each roller 10 in a fixed state of rotation (no translation, no tilting) and instead employs three-axis control of the grinding device (see FIG. 8A) as well as application pressure to more accurately crown the roller thereby obviating multiple cycles and multiple assessments.

Figure 12:
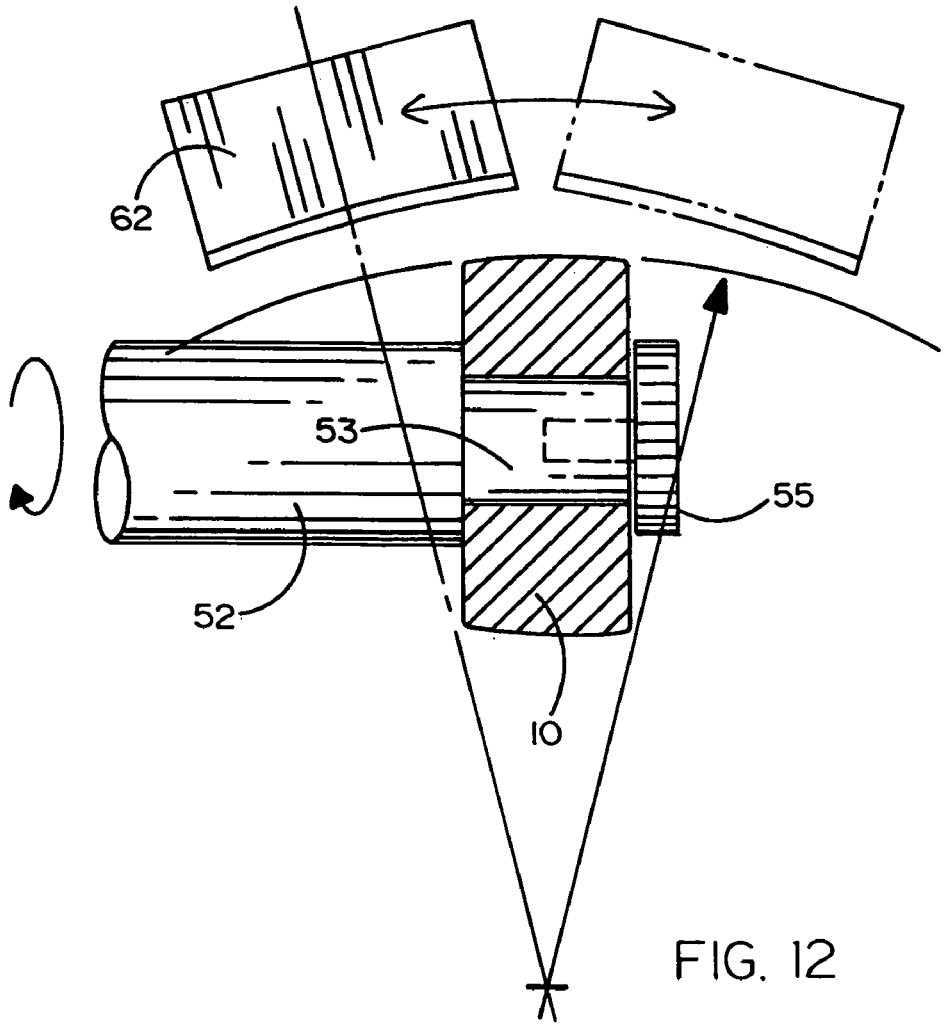
FIG. 12 is an enlarged view of the roller/grinding device rotary interaction during a crowning operation.
Figure 9:
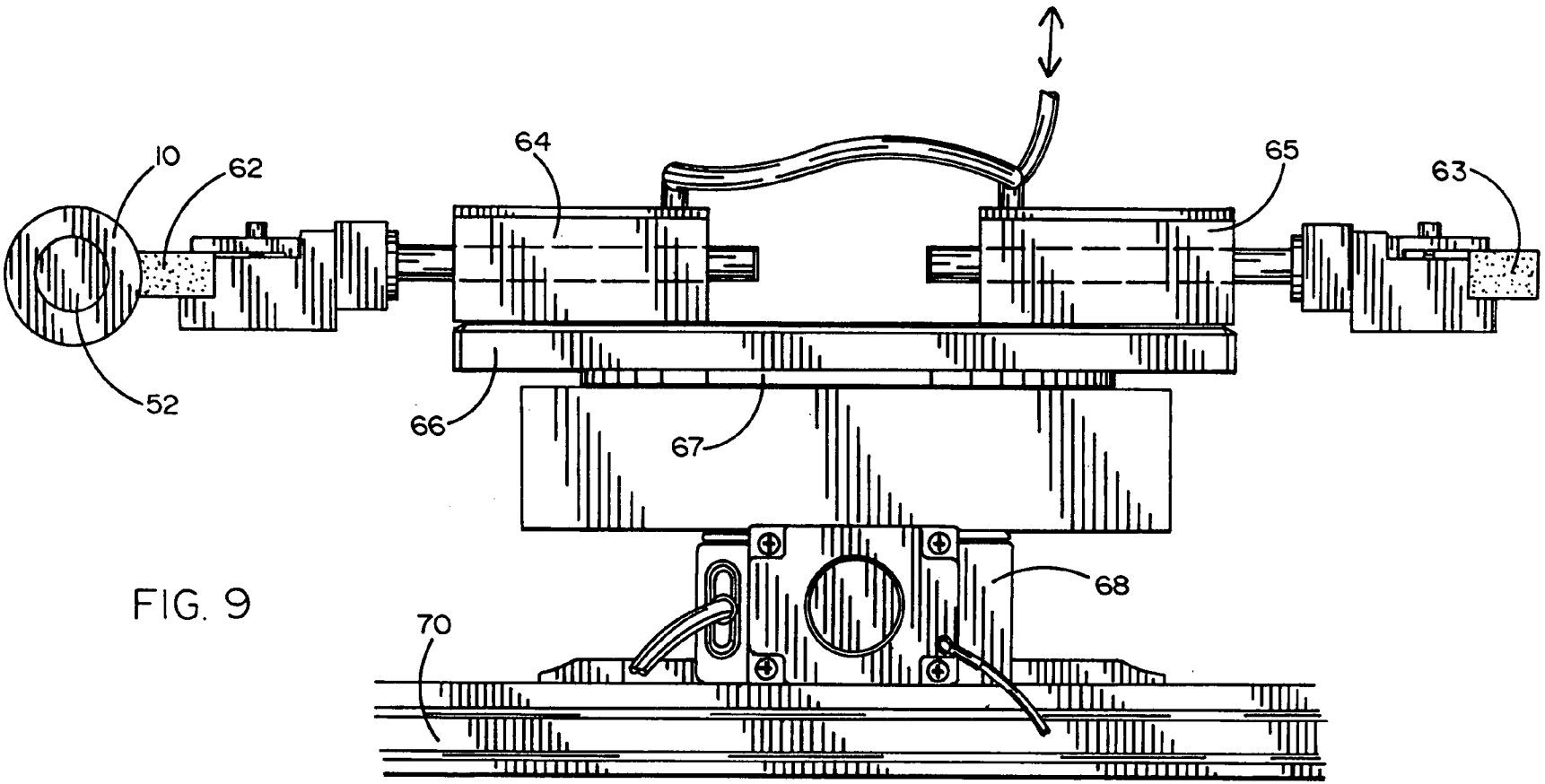
FIG. 9 is a side view of the preferred embodiment of FIG. 8.
Figure 10:
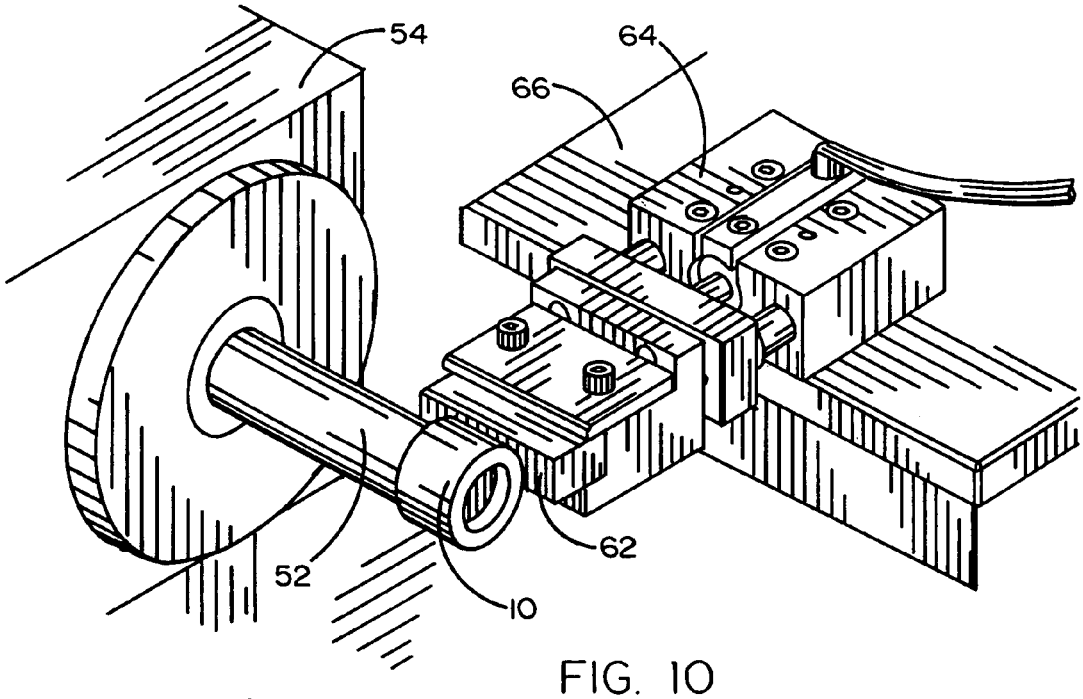
FIG. 10 is an enlarged view of the grinding device of the preferred embodiment shown in engagement with a roller for crowning the radial surface thereof.
Figure 11:
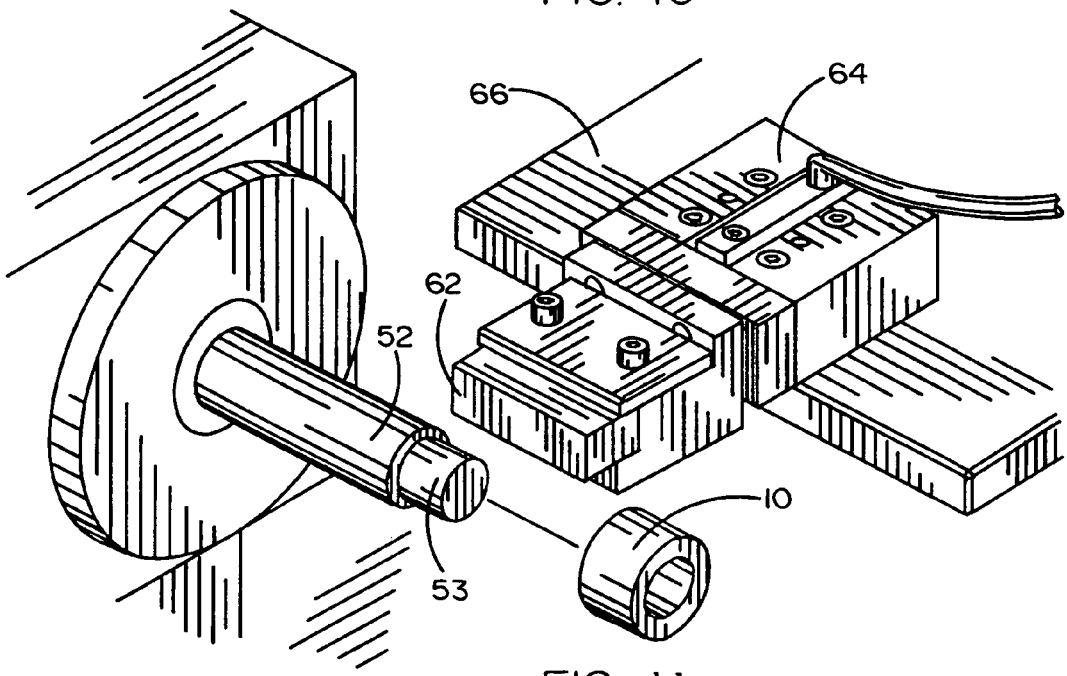
FIG. 11 is a view similar to that of FIG. 10, but showing the grinding device disengaged and the roller removed from the spindle.

As seen best in FIG. 12, as the grinding device is moved to one side or the other of the ceramic roller, the grinding surface is pointed toward the center of the crown radius to "mirror" the crown shape precisely and thus improve the "roundness" of the roller's radial profile.

Figure 13:
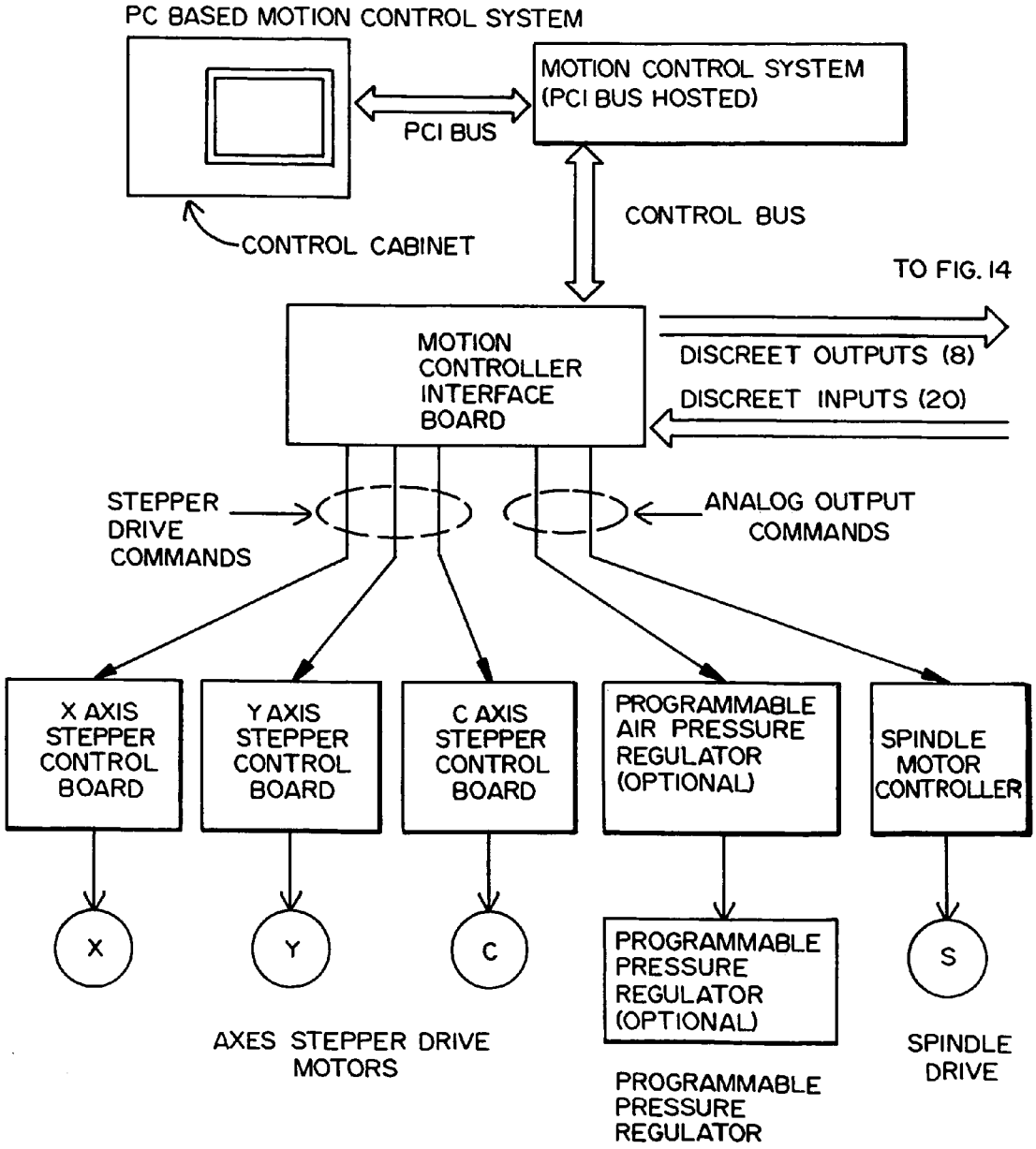
FIG. 13 is a block diagram of the preferred embodiment of FIG. 8.
Figure 14:
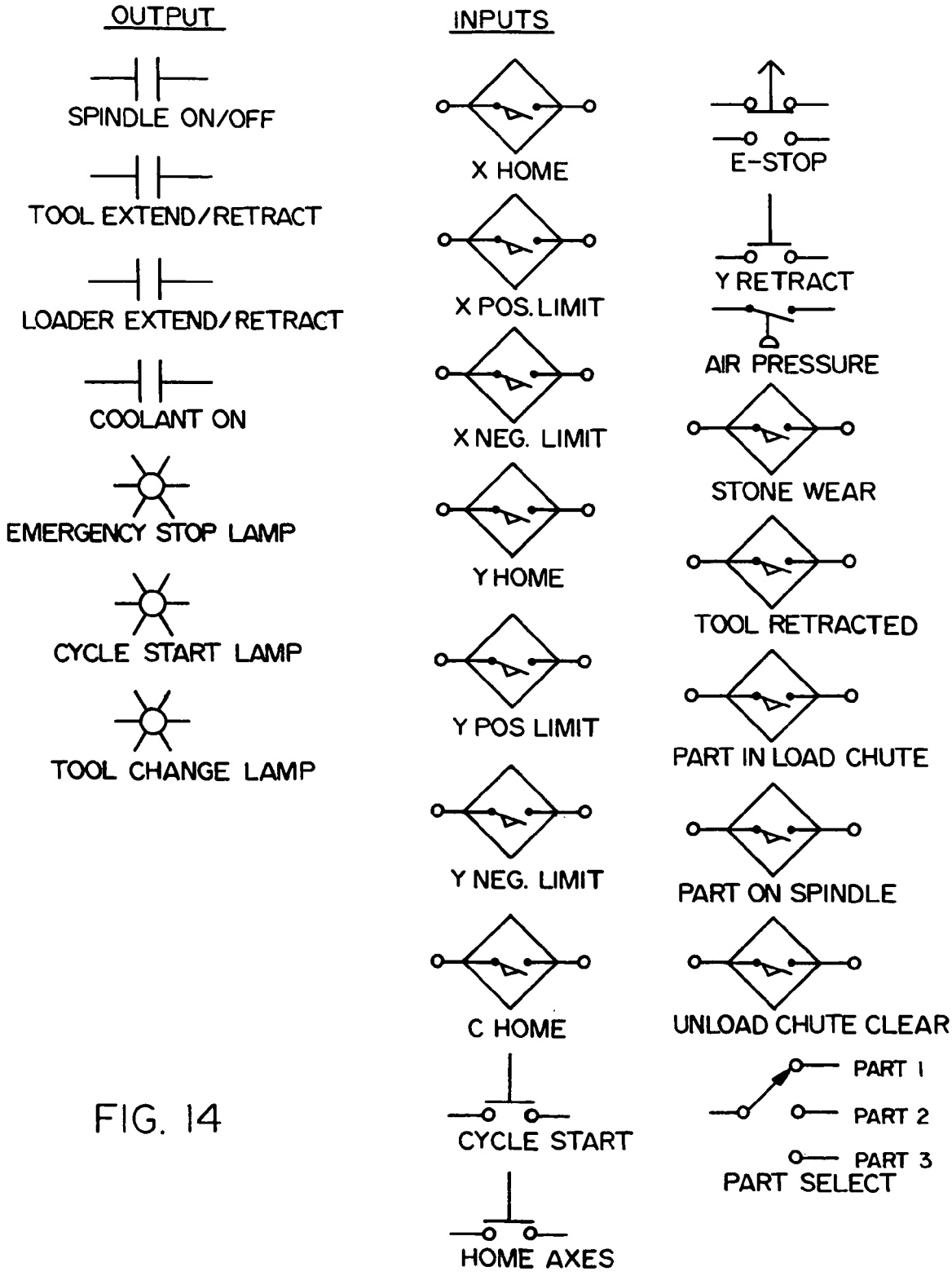
FIG. 14 is a representation of the inputs and outputs of the motion controller interface board of FIG. 13.

FIGS. 13 and 14 provide a block diagram description of the entire preferred embodiment. As shown therein, each stepper-motor has a devoted control board in a PC-based motion and control system including a motion controller interface board. The latter receives a plurality of discreet inputs to precisely motion limits and related operations. It also provides motion-related outputs in the form of monitoring indications. Precise crowning parameters are programmed at the control cabinet using commercially available CNC software in a well-known manner. Analog output signals are also provided by the motion controller interface board to control spindle motor rotation and air pressure regulation for the grinding devices.

It will now be understood that what has been disclosed herein are a method and apparatus for crowning ceramic rollers with increased accuracy and precision as compared to conventional systems. It will be further understood that the present invention may be employed to form virtually any complex shape on the radial surface of cylindrical rollers. It will be apparent that various modifications and additions may be made to the disclosed embodiment. By way of example, different axes and controllers may be employed to achieve the precisely controlled motion of a grinding device. Accordingly, the scope hereof is to be limited only by the appended claims and their equivalents.

I claim:

1. An apparatus for modifying the shape of the outer radial surface of a cylindrical roller; the apparatus comprising:

a motorized spindle for receiving a cylindrical roller and rotating said roller about a fixed axis;

a grinding device for controlled engagement with said outer radial surface of said rotating roller for selected removal of surface material thereof;

a multi-axis position controller affixed to said grinding device for controlling the position and orientation of said grinding device relative to said outer radial surface; and programmable means for setting operating parameters of said position controller for a selected shape modification of said cylindrical roller;

wherein said multi-axis position controller has three axes of control.

2. An apparatus for modifying the shape of the outer radial surface of a cylindrical roller; the apparatus comprising:

a motorized spindle for receiving a cylindrical roller and rotating said roller about a fixed axis;

a grinding device for controlled engagement with said outer radial surface of said rotating roller for selected removal of surface material thereof;

a multi-axis position controller affixed to said grinding device for controlling the position and orientation of said grinding device relative to said outer radial surface; and programmable means for setting operating parameters of said position controller for a selected shape modification of said cylindrical roller;

wherein said multi-axis position controller has two orthogonal linear axes and a circular axis of control.

3. An apparatus for modifying the shape of the outer radial surface of a cylindrical roller; the apparatus comprising:

a motorized spindle for receiving a cylindrical roller and rotating said roller about a fixed axis;

a grinding device for controlled engagement with said outer radial surface of said rotating roller for selected removal of surface material thereof;

a multi-axis position controller affixed to said grinding device for controlling the position and orientation of said grinding device relative to said outer radial surface; and programmable means for setting operating parameters of said position controller for a selected shape modification of said cylindrical roller;

wherein said multi-axis position controller has a first linear axis of control that is parallel to said fixed axis, a second linear axis of control that is perpendicular to said fixed axis, and a circular axis of control that is perpendicular to both said first and second linear axes of control.

4. The apparatus recited in claim 1 further comprising a pressure controller for regulating the compression of said grinding device against said roller.

5. The apparatus recited in claim 4 wherein said pressure controller is controlled by adjustable pneumatic pressure responsive to said programmable means.

6. The apparatus recited in claim 1 wherein said multi-axis controller comprises stepping motors for controlling the position and orientation of said grinding device.

7. A method for modifying the shape of the outer radial surface of a cylindrical roller; the method comprising the steps of:

placing a roller on a motorized spindle for rotating said roller about a fixed axis;

engaging a grinding device with said rotating roller for selected removal of surface material thereof;

controlling the position and orientation of said grinding device in relation to a plurality of different axes using a corresponding plurality of stepping motors; and programming said stepping motors for altering the position and orientation of said grinding device to achieve a selected shape modification of said cylindrical roller;

wherein said controlling step comprises the step of using three axes of control of said grinding device.

8. A method for modifying the shape of the outer radial surface of a cylindrical roller; the method comprising the steps of:

placing a roller on a motorized spindle for rotating said roller about a fixed axis;

engaging a grinding device with said rotating roller for selected removal of surface material thereof;

controlling the position and orientation of said grinding device in relation to a plurality of different axes using a corresponding plurality of stepping motors; and programming said stepping motors for altering the position and orientation of said grinding device to achieve a selected shape modification of said cylindrical roller;

wherein said controlling step comprises the step of using two orthogonal linear axes and a circular axis of control.

* * * * *